US009821954B2

(12) United States Patent
Clive-Smith et al.

(10) Patent No.: US 9,821,954 B2
(45) Date of Patent: Nov. 21, 2017

(54) BOX FOR REINFORCING A SHIPPING CONTAINER

(71) Applicants: Martin Clive-Smith, Wootton (GB); Brendan Paul McKenna, Houston, TX (US)

(72) Inventors: Martin Clive-Smith, Wootton (GB); Brendan Paul McKenna, Houston, TX (US)

( * ) Notice: Subject to any disclaimer, the term of this patent is extended or adjusted under 35 U.S.C. 154(b) by 0 days.

(21) Appl. No.: 14/784,153

(22) PCT Filed: Apr. 11, 2014

(86) PCT No.: PCT/GB2014/000143
§ 371 (c)(1),
(2) Date: Oct. 13, 2015

(87) PCT Pub. No.: WO2014/170624
PCT Pub. Date: Oct. 23, 2014

(65) Prior Publication Data

US 2016/0075510 A1 Mar. 17, 2016

(30) Foreign Application Priority Data

Apr. 15, 2013 (GB) ..... 1306780.6
May 17, 2013 (GB) ..... 1308985.9
Feb. 21, 2014 (GB) ..... 1403129.8

(51) Int. Cl.
*B65D 90/02* (2006.01)
*B65D 90/04* (2006.01)
(Continued)

(52) U.S. Cl.
CPC ..... *B65D 90/046* (2013.01); *B65D 88/022* (2013.01); *B65D 88/025* (2013.01);
(Continued)

(58) Field of Classification Search
CPC ..... B65D 90/046; B65D 2590/0066; B65D 2590/046; B65D 88/12
(Continued)

(56) References Cited

U.S. PATENT DOCUMENTS 3,937,390 A * 2/1976 Winkler ..... B65D 5/003 206/448
6,223,903 B1 * 5/2001 Mansouri ..... B65D 71/02 206/600
(Continued)

FOREIGN PATENT DOCUMENTS

WO 2011018768 A1 2/2011

OTHER PUBLICATIONS

International Search Report in related PCT Application No. PCT/GB2014/000143, dated Nov. 4, 2014.

*Primary Examiner* — Stephen Castellano
(74) *Attorney, Agent, or Firm* — Troutman Sanders LLP; Ryan A. Schneider

(57) ABSTRACT

A system for transporting fluid cargo within a shipping container, the system comprising an open topped box having side walls and end walls and a flexible membrane which either independently or in combination with the box contains the fluid cargo. The box supports the portion of the cargo within the box and is designed to flex and absorb at least part of the horizontal forces generated within the cargo during its transportation thus preventing overloading of the walls of the surrounding container. The membrane may be a bladder which completely encloses the cargo and is disposed partially within the box to contain the cargo independently of the box. The box may have a floor pan which can seal the box against leakage of any cargo.

19 Claims, 8 Drawing Sheets

(51) Int. Cl.
*B65D 88/02* (2006.01)
*B65D 88/74* (2006.01)
*B65D 88/12* (2006.01)

(52) U.S. Cl.
CPC ..... *B65D 88/12* (2013.01); *B65D 88/744* (2013.01); *B65D 2590/0066* (2013.01); *B65D 2590/046* (2013.01)

(58) Field of Classification Search
USPC ..... 220/495.06, 1.6, 495.01
See application file for complete search history.

(56) References Cited

U.S. PATENT DOCUMENTS

| | | | | |
|---|---|---|---|---|
| 6,250,488 | B1 * | 6/2001 | Narahara | B65D 90/046 220/1.6 |
| 7,264,147 | B1 * | 9/2007 | Benson | B65D 5/566 229/117.09 |
| 2009/0159592 | A1 * | 6/2009 | Vitalis | B65D 88/125 220/1.5 |
| 2009/0308876 | A1 | 12/2009 | Christofferson et al. | |
| 2010/0012550 | A1 * | 1/2010 | Dedmon | B65D 77/061 206/600 |
| 2010/0122981 | A1 | 5/2010 | Sims | |
| 2012/0087760 | A1 | 4/2012 | Sims | |

* cited by examiner

BOX FOR REINFORCING A SHIPPING CONTAINER

CROSS-REFERENCE TO RELATED APPLICATIONS

This application is a US National Stage of International Application No. PCT/GB2014/000143, filed 14 Apr. 2014, which claims the benefit of GB1403129.8. filed 21 Feb. 2014 and GB Application No. GB1308985.9, filed on 17 May 2013 and GB Application No. GB1306780.6, filed 15 Apr. 2013, each incorporated fully by reference herein.

In the field of shipping containers, there is a need to ship non-hazardous fluid cargo not in expensive purpose built stainless steel tank containers but within standard rectangular shipping containers, the fluid being contained within a flexible membrane in the form of a flexible bag or bladder of polythene or other suitable plastics material. Such bags typically contain 24,000 liters (24 tonnes if water) of fluid but have themselves very little structural capability and thus rely on the strength of the sides and ends of the container to stop the bags bulging out and bursting.

This problem is increased when the shipping container is being transported by road, rail or sea when surging or sloshing of the fluid cargo can result in excessive loads being applied to the side walls and end walls of the container resulting in massive and sudden pressure, particularly on the long sidewalls of the container, resulting in permanent damage to the sidewalls necessitating expensive repair and possible rupture of the bags with consequent damage by the fluid to other containers and adjacent equipment This is particularly significant when the container is being carried on board a ship where the ships pumps are designed only for pumping sea water. Should the fluid cargo be one that sets, such as latex, blocking valuable bilge pumps and pumping systems is not only highly dangerous but is also expensive to remedy.

These problems have led the regulating authorities to suggest that the cargo size should be limited to say 16,000 liters with consequent increases in transportation costs and carbon emissions.

It is an object of the present invention to provide a system for transporting fluid cargo within a shipping container which mitigates the above problems.

Thus according to the present invention there is provided a system for transporting fluid cargo within a walled shipping container, the system comprising an open topped box having side walls and end walls and a flexible membrane which either independently or in combination with the box contains the fluid cargo, the box supporting the portion of the cargo within the box and being designed to flex and absorb at least part of the horizontal forces generated within the cargo during its transportation thus preventing overloading of the walls of the surrounding container.

The box may have a floor pan which seals the box against leakage of the cargo and the cargo may be contained by the flexible membrane and the box together with the membrane being sealingly attached to the box and retaining against leakage but not necessarily structurally part of the cargo above an upper rim of the box.

The membrane may comprise a bladder which completely encloses the cargo and is disposed partially within the box to contain the cargo independently of the box.

A top rail extends around an upper rim of the open topped box, the top rail and box walls together supporting the portion of the cargo within the box during transportation.

The end and/or side walls of the box may be of a double skinned construction with gussets between the skins, these double skinned walls supporting the portion of the cargo within the box during transportation. Cargo cooling or heating pipes may extend between the skins of the double skinned walls.

The box has a floor pan which may seal the box against leakage.

The end wall of the box adjacent a rear door of the container may include an aperture to receive a cargo loading/unloading valve connected with the interior of the flexible membrane.

The box and/or the shipping container may be provided with levers, cams or other devices to position the box in a desired position on the floor of the container.

The flexibility of the box under its proportioned load is designed to be not more than the elastic limit of the surrounding walls of the container.

A protective sheet may be provided which extends over the membrane to protect the membrane and to confine any leakage of the cargo through the membrane to within the box.

Straps may be provided over the top of the membrane and any protective sheet fitted to control movement of the fluid cargo within the membrane during transportation.

The straps may be attached to the sides and/or ends of the box. Alternatively one end of the straps may be attached to the box and the other end may be attached to the container.

The end wall of the box adjacent the rear door of the container may include a door to allow insertion and removal of a bladder type membrane or access to the interior of a membrane sealed to the box or to any valve fitted when the system is in use.

The sides and ends of the box are preferably outwardly sloping so that boxes can be stored in a nested configuration when not in use.

The box may have nesting stops which prevent the box jamming when nested and which ensure spacing between the floor pans of adjacent nested boxes to accommodate between the adjacent floor pans any membrane or protective sheet which is used.

The protective sheet may be fastened inside and below the top rail so that when empty the sheet falls inside the box clear of a second nested box to allow nesting of the boxes without the need to detach the sheet.

The box may have bolts or other fasteners which engage the shipping container to prevent relative movement between the box and container during transportation.

The box may have rounded corners where the side and end walls join to more readily conform to the shape of the bladder type membrane.

A second box may be mounted in an inverted configuration on the top rail of the upper rim of the other box to totally enclose the membrane within the boxes.

In such an arrangement the floor pan of the upper box forms a roof for the double box arrangement, the roof including a ventilator.

The underside of the roof may carry downwardly projecting beams which press into the membrane to reduce surging of the fluid cargo within the membrane during transportation.

The inside of the box may be coated with a spongy layer to protect the membrane from damage by contact with the box during transportation.

The floor pan of the box may have a convex domed shape which curves upwardly when the membrane is empty and which deflect to a more flat configuration as the membrane is filled.

The invention also provides a method of transporting a fluid cargo to a desired location within a shipping container comprising the steps of providing an open topped box having side walls and end walls, providing a membrane which either independently or in combination with the box can contain the fluid cargo, placing the membrane and box within the shipping container, loading the cargo within the membrane with the lower portion of the cargo supported by the box to prevent at least part of the horizontal forces generated within the cargo during transportation from overloading the walls of the surrounding shipping container, transporting the shipping container and loaded membrane to the desired location, and unloading the cargo from within the membrane.

Several embodiments of the present invention will row be described, by way of example only, with reference to the accompanying drawings in which.

Figure 9A:
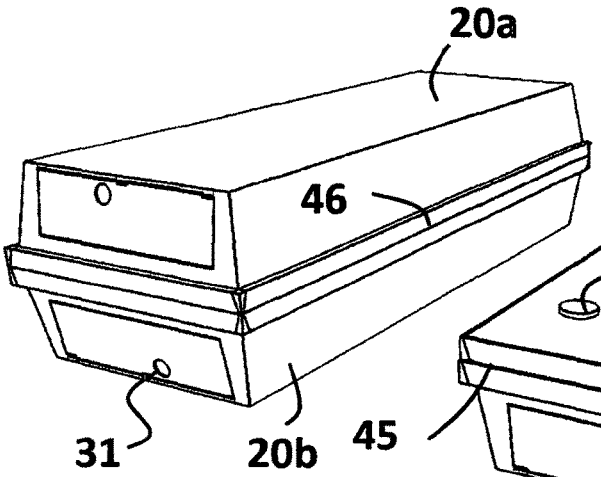
FIG. 9A shows two boxes positioned one on top of the other to from a protective compartment for the shipping of a fluid cargo.
Figure 9B:
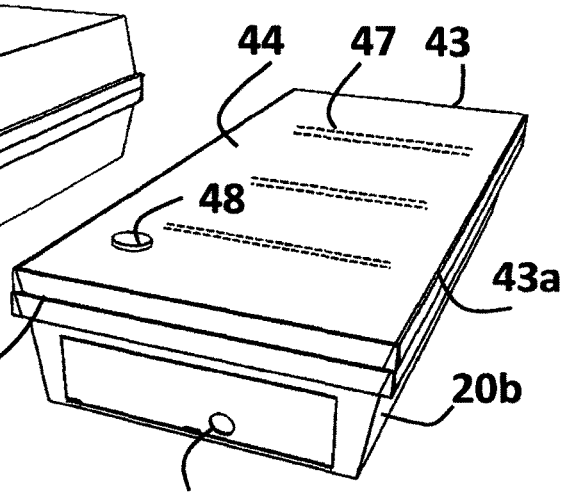
Figure 10:
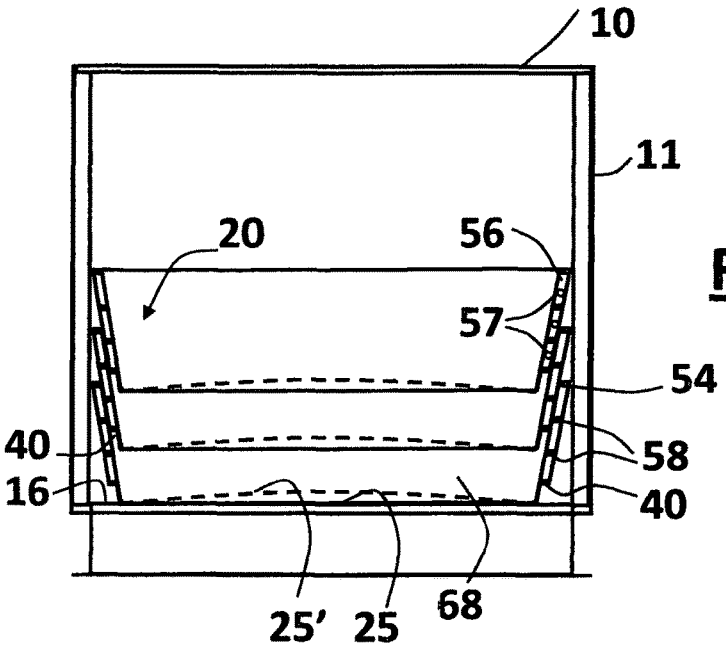
Figure 11:
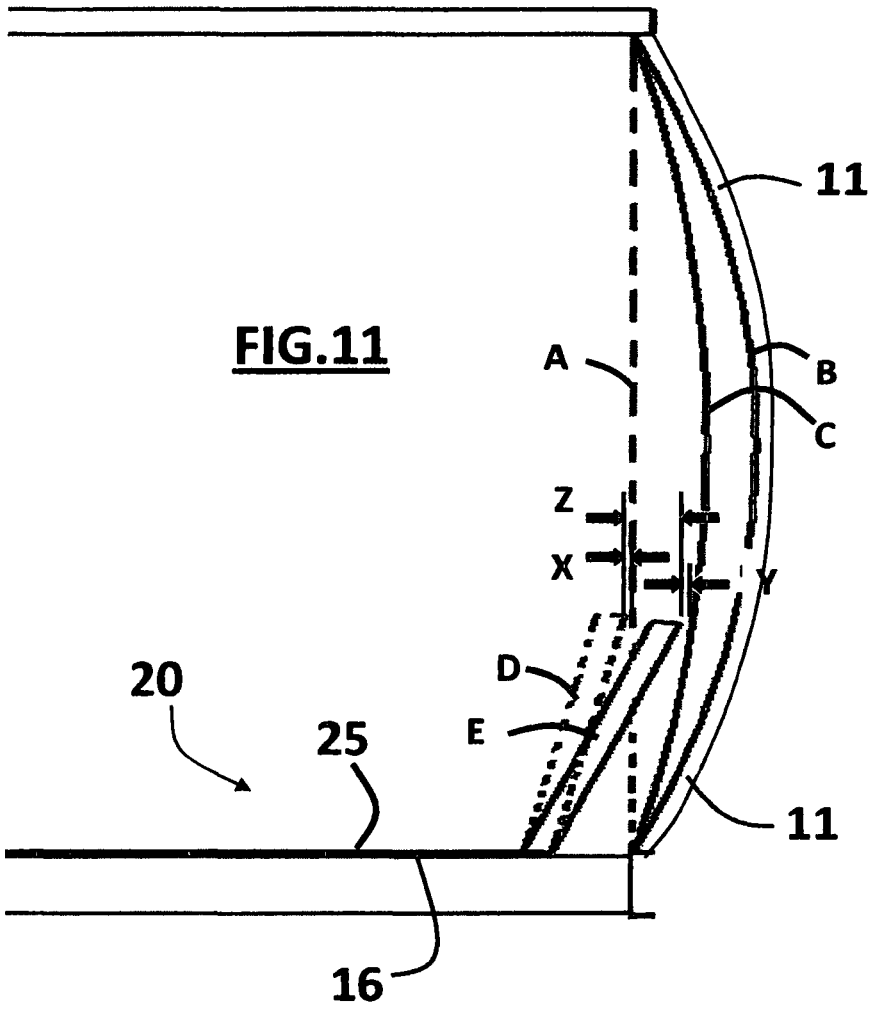
Figure 13:
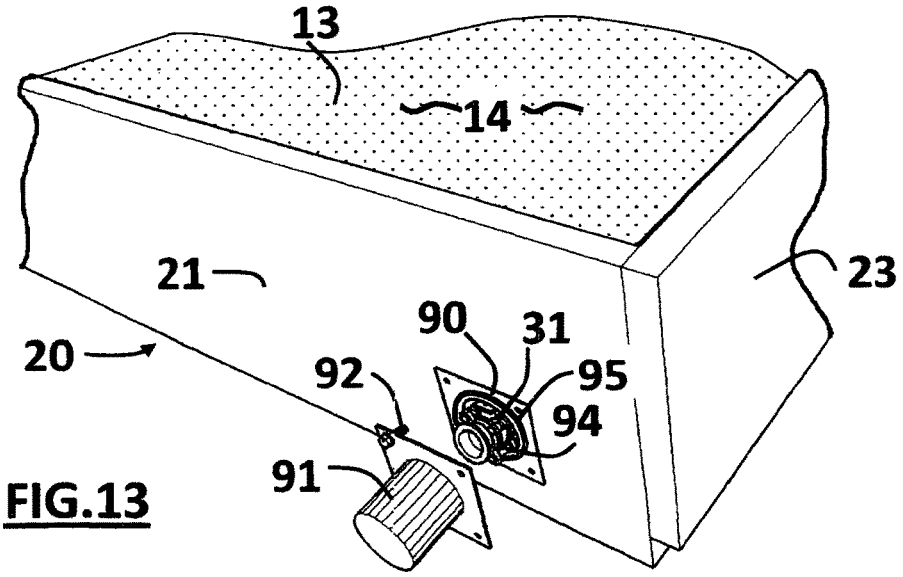
Figure 14A:
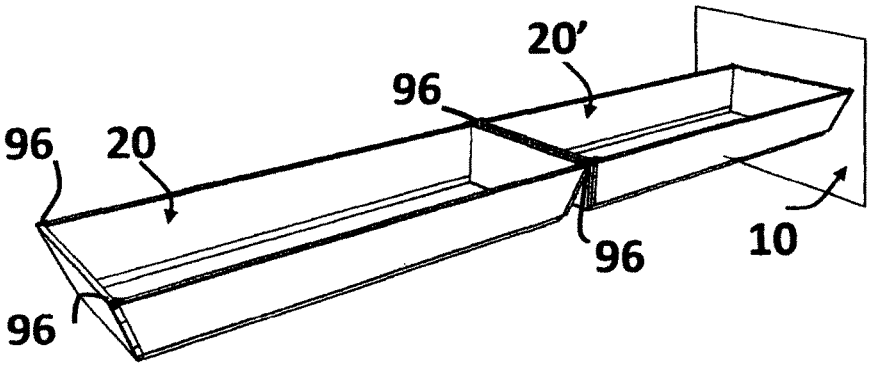
Figure 14B:
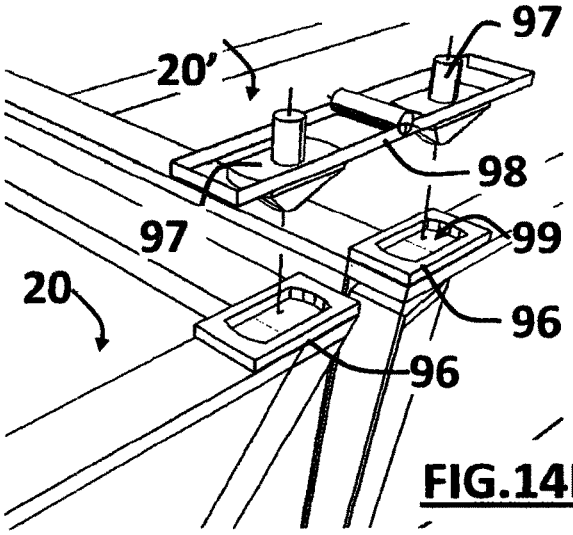

FIG. 9B and an alternative arrangement with a single box provided with a roof attachment;

FIG. 10 Shows a vertical section through an alternative double skinned box arrangement nested inside a container;

FIG. 11 Shows diagrammatically how in the system of the present invention the walls of the box and the walls of the surrounding container cooperate to control the forces which arise in the fluid cargo during transportation to avoid damage to the container walls;

FIGS. 12A to 12E show various further alternative box wall constructions in section which can be used in an arrangement in accordance with the present invention;

FIG. 13 shows details of how to leak seal a flexi-tank valve passing through the end wall of a box in accordance with the invention, and FIGS. 14A and 14B show a tandem arrangement of boxes used to carry fluid cargo.

Figure 1:
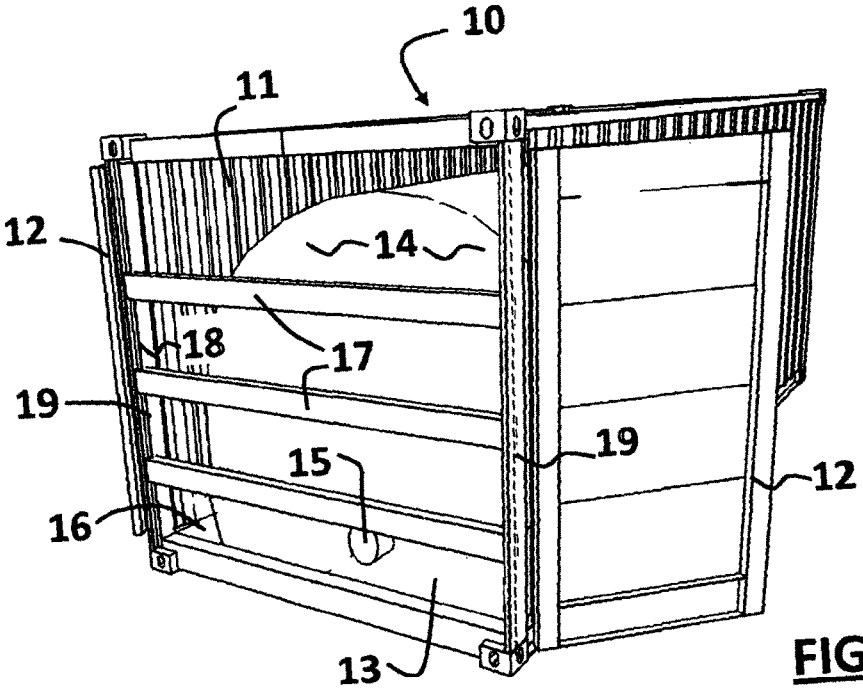
FIG. 1 Prior Art
FIG. 1 shows a perspective view of a prior art arrangement for transporting a fluid cargo in a shipping container.

Referring to the drawings, FIG. 1 shows a prior art form arrangement for the transportation of a fluid cargo in which a container 10 having side walls 11 and doors 12 has a known flexible membrane in the form of a flexi-tank or bladder 13 housed inside the container with a fluid cargo 14 (typically a liquid such as wine, water, latex or paint) inside the flexi-tank. Loading and unloading of the flexi-tank is by means of a pump attached to a valve, shown diagrammatically at 15, located at low level for eventual discharge of the cargo. Until recently such flexi-tanks for use in a 20 ft long container were filled with 24 tonnes of cargo but, as discussed above, it has recently been found that the dynamic pressures resulting from the transportation and handling of the container on road, rail, sea and the craning on and off a ship result in the pressure acting on the container side walls 11 are too great for the strength of the side walls causing permanent and costly damage to the container.

In use, the side walls 11 and floor 16 of a container which has been used for general cargo can become jagged and splintered and corroded to such a degree that the flexi-tank 13 can become scuffed, worn or even punctured by debris such as nails, screws, steel banding and general dirt can also remain on the floors of the container adding to the dangers of puncture. Typically in an attempt to prevent such puncture and wear, the interior surfaces of the container walls and floor are lined with corrugated cardboard and the like to cushion and protect the bladder. This is a costly and skilled exercise to install. Also, in the event of leakage of the cargo, there is no means provided to absorb the leak or prevent the cargo from leaking out through gaps in the floor and doors 12 and into the bilges of ships, or elsewhere.

Further, to prevent the cargo bearing on the end doors 12, there are fitted a number of horizontal beams 17 slotted into known shoring slots 18 formed in the corner posts 19 of the container located some inches away from the interior surface of the doors 12 when closed. So as the flexi-tank 13 and its cargo 14 surges towards the doors 12 during transport the beams 17 support the flexi-tank. Furthermore, should the doors be opened for inspection of the contents of the container or for discharge of the cargo, the flexi-tank is prevented from falling out of the container onto personnel or the ground. The fitting of such restraining beams 17 is now mandatory.

Figure 2:
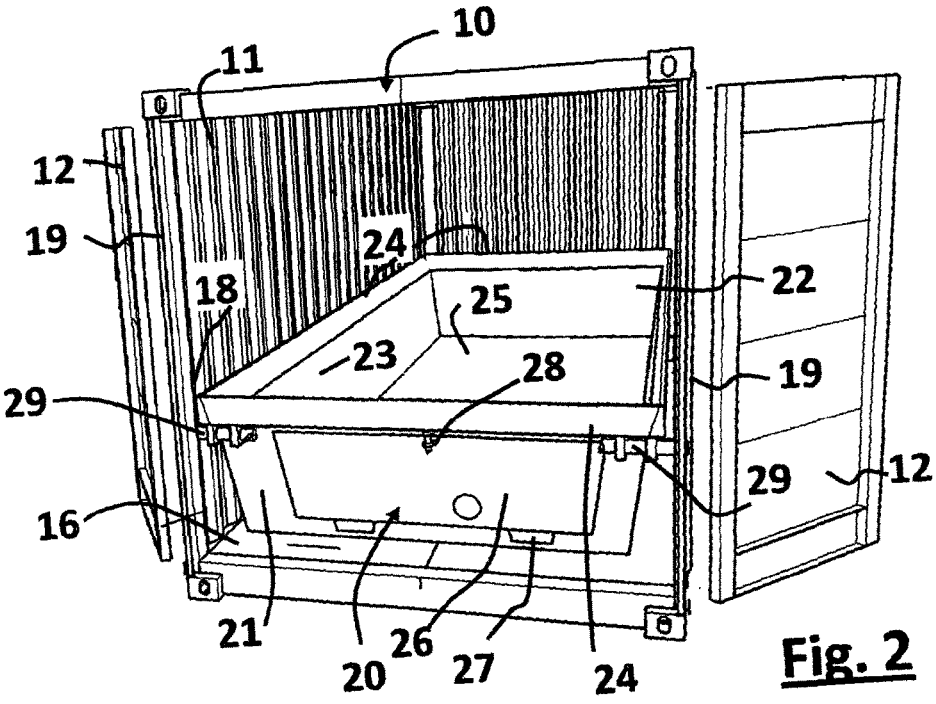
FIG. 2 shows a perspective view of a support box which forms part of an arrangement in accordance with the present invention for transporting a fluid cargo in a shipping container.

FIG. 2 again shows a typical shipping container 10 with side walls 11, opening doors 12, floor 16, and corner posts 19. The floor is a load bearing structure which may, for example, comprise 28 mm thick plywood sheet covering the whole floor surface this supported by steel bearers underneath welded to the side structure of the container to form a strong rigid platform surface.

Inside the container is shown a first embodiment of the present invention in which an open topped box 20 has a rear wall 21, front wall 22 and side walls 23. There are several ways in which to form the walls 21, 22 and 23. In this example there is a top rail 24 running around the upper rim of the largely rectangular plan shape of the box. This top rail 24 may be a separate component welded to the upper rim or may be formed integrally with the walls by bending a continuation of the wall material over to form the rail.

The box 20 has a floor pan 25 preferably shaped for drainage of liquid and other bulk cargo when discharging thus avoiding puddles and pockets of cargo remaining in the box. Ideally the pan 25 is a simple flat sheet of steel or stainless steel, painted against corrosion. In use filled with cargo (to be described later) the pan 25 is intended to be supported by the structural container floor 16 beneath it. The pan can be of as little thickness as 1 to 2 mm although thicker is acceptable and provides more damage resistance. The pan might be made from metal such as steel or aluminum or indeed a plastic, and if leak containment were not required, then the pan might be of a mesh construction bridging from one side of the box to the other or indeed absent entirely with the flexi-tank 13 resting directly on the container floor 16.

In this example the end wall 21 incorporates a door 26 attached via hinges 27 to the pan 25 of the box 20. The door 26 can be hinged open to provide access to the interior of the box 20 for cleaning or taking in or out an empty folded flexi-tank 13. On the top of the door 26 is a lock 28 locking the door shut to the top rail 24 of end wall 21.

At the top of each corner of the end wall 21 of the box 20 there is provided locking devices, such as shoot bolts 29, which when withdrawn lie within the profile of the end wall 21 yet when operated project out and are inserted into the shoring slots 18 of the posts 19 embodied in common shipping containers. Once they have penetrated the slots, the box 20 is restrained from sliding longitudinally fore and aft of the container 10.

Figure 3:
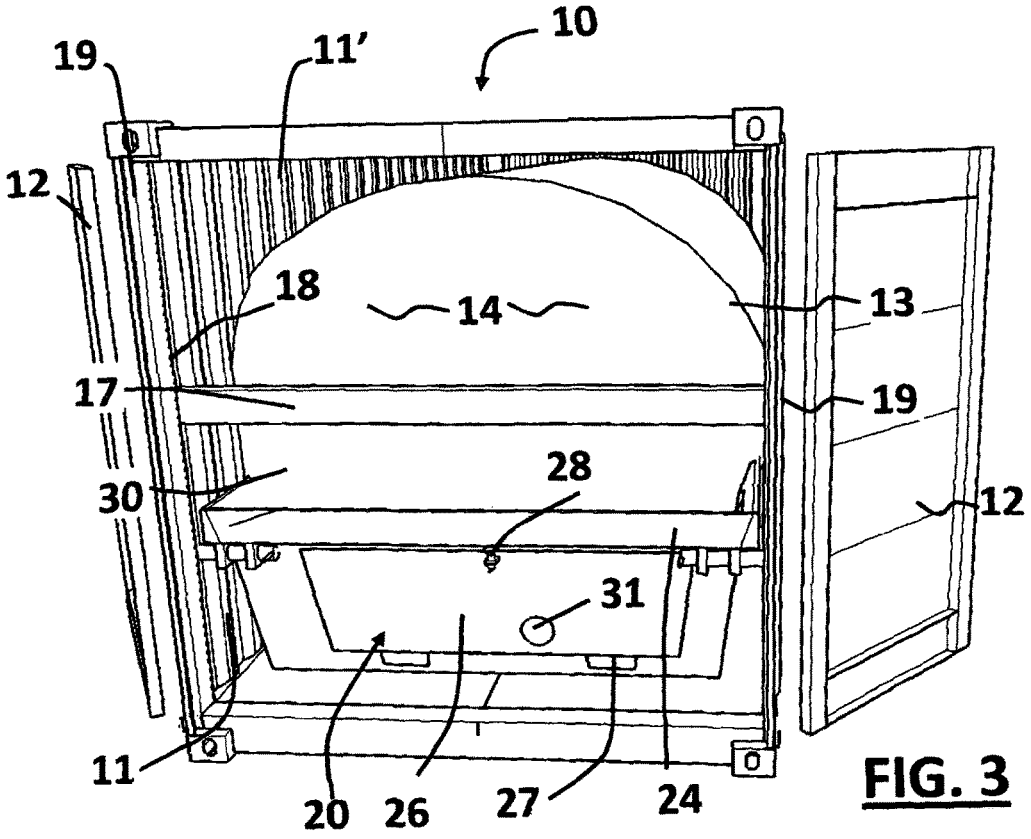
FIG. 3 shows a perspective view of the arrangement of FIG. 2 with a flexible cargo containing membrane in position in the support box.

FIG. 3 shows a typical flexi-tank 13 loaded into the box 20 and filled with liquid cargo 14. The size of the filled flexi-tank is seen to be greater than the volume of the box 20 and not fully contained within it such that the visible upper part 30 of the flexi-tank 13 bears on at least the upper part 11' of side walls 11 of the container 10. The unseen bottom of the flexi-tank bears on the pan 25, and its side faces within the box 20 bear on side walls 23 and the front and rear walls 21 and 22 of the box 20. Box 20 is reserved to carry only the delicate flexi-tanks 13 so that no rough general cargo comes near the internal surfaces of the sides, floor and rails of the box 20 to spoil the manufactured smooth internal surfaces. This then saves the cleaning and repairing of the internal surfaces that are needed to the floors 16 and walls 11 of a standard container before a flexi-tank can be safely loaded therein. Whereas the top rail 24 and end wall 21 adjacent to the doors 12 will hold back any cargo movement towards the doors, the upper part of the flexi-tank would still tend to surge over the top rail. Thus beams 17, albeit a smaller number, would be required to be fitted to the shoring slots 18 in the container door posts 19 to restrain the flexi-tank as described earlier.

To provide access to the valve 15 of the flexi-tank, an aperture 31 is formed in the end wall 21 or optional door 26 through which the valve 15 of the flexi-tank may project or be accessed. Further details of the aperture are seen in FIG. 13. The Box 20 is manufactured to be fluid-tight in case of leakage with its walls 21, 22 and 23 welded or bonded or fastened to the pan 25 which if a continuous skin to contain any leakage from the flexi-tank.

Figure 4:
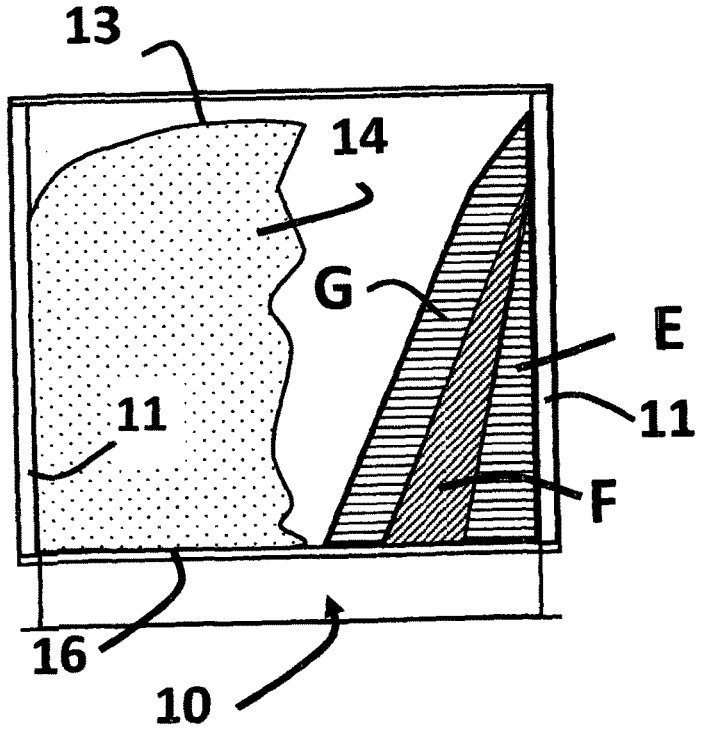
FIG. 4 shows a graph of the forces applied to the container walls when using the prior art arrangement of FIG. 1 imposed on a view of the container seen in vertical section from the door end.

In FIG. 4 there is shown a diagrammatic representation of the prior art arrangement of FIG. 1 with a pressure graph plotted over the depiction of a container 10 with side walls 11 and with a flexi-tank 13 filled cargo 14 and located inside and for illustrative purposes cut away near the vertical centre line. The pressure on one or both the sidewalls 11 at any time is made up of the static pressure of the cargo 14 denoted by graph zone E increasing from zero at the top free surface 71 of the liquid to a substantial figure down at floor 16. However once a transport mode is introduced, other forces into play. As an example on a ship in rough seas, a vertical acceleration as the ship hits a wave the pressure denoted by zone F is an additional pressure to be supported by the sidewall 11 of the container. But then dynamic transverse accelerations and payload mass shifts caused by the ship simultaneously recovering from a roll to further increase pressure denoted by zone G. The combined pressure (E+F+G) can more than double the static pressure acting on the structure of container 10 in particular the sidewall 11. The pressure is seen to be greatest at the level of floor 16.

A much taller wall 23 could be made to support even the whole height of the flexi-tank to the top and thus protect the container sidewall completely. However this would add substantial tare weight and cost to the box 20, and make the box 20 bulky so as to occupy a large volume when empty. Various studies have shown that the sidewall 11 of a typical shipping container 10 cannot support the whole pressure exerted upon it, denoted by graph zones E, F and G. However the container wall 11 can support some of the cargo pressure itself.

Figure 5:
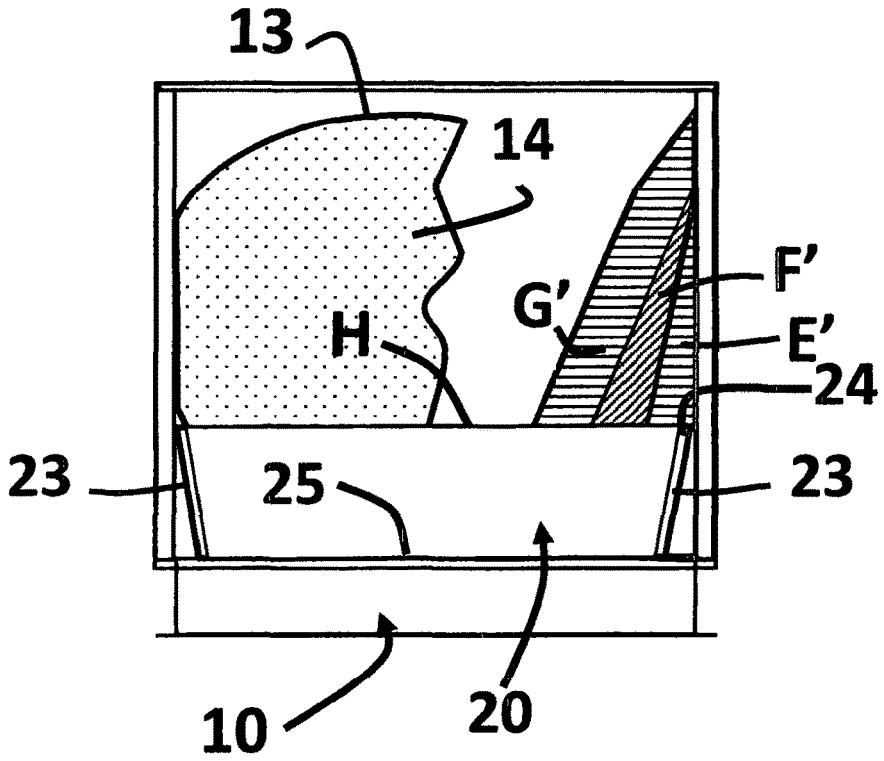
FIG. 5 shows a graph of the forces applied to the container walls as in FIG. 4 when using the arrangement of the present invention.

In FIG. 5 there is seen an example of the invention in the form of a box 20 inserted in a shipping container 10 and containing a flexi-tank 13 as in FIG. 4. A similar graph to that of FIG. 4 is seen but with the lower part of the flexi-tank now supported by the sides 23 of the box 20 such that the actual load sported by the side walls 11 of the container is very much reduced as illustrated by the pressures of static, vertical acceleration and horizontal acceleration indicated by graph zones E', vertical F' and G' of FIG. 5 which terminate at the top rail 24 of the box 20 demarcated by line H. The remaining pressures below line H are now supported away from the sidewall 11 by wall 23 of the box 20. The total pressure on the side walls 11 is now reduced to Levels E'+F'+G' which are less than the levels E+F+G in FIG. 4, the box 20 having supported pressures equal to the difference between the previous levels E+F+G less the levels E'+F'+G' now supported by the sidewall. In this way by cooperation between the capability of the sidewall 11 above the top rail 24 of the box 20 and the wall 23 of the box 20, the whole cargo force system can be safely supported. If the height H of the box 20 were to be increased together with its strength, then so too could be the payload to typically 27 tonnes without overloading the sidewall 11.

Figure 6:
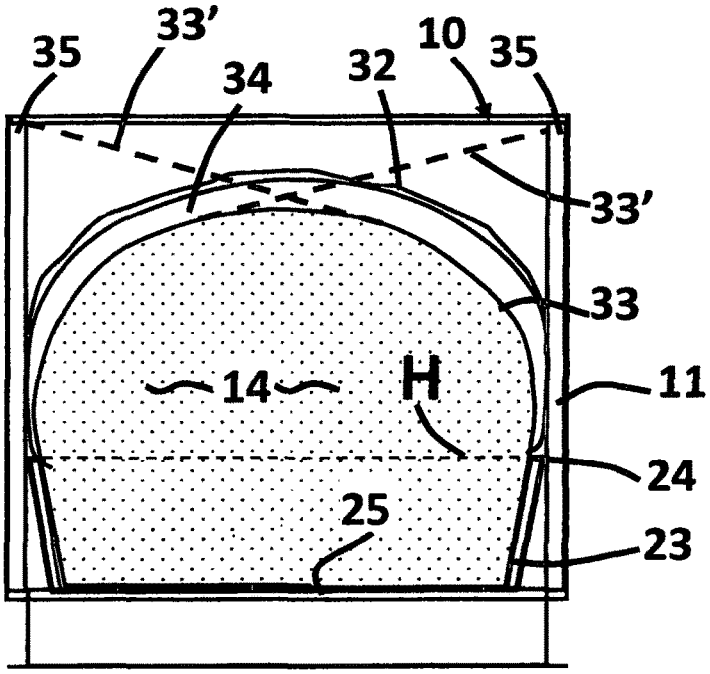
FIG. 6 shows an additional protective cover and sloshing straps which may be used in an arrangement in accordance with the present invention the container and the invention being seen in vertical section from the door end of the container.

FIG. 6 shows that an optional flexible membrane in the form of a protective sheet or liner 32 may be fixed all around the top rail 24 of the box 20 so that in the event of a heavy leakage from the flexi-tank 13 the leak might be contained within the volume formed by liner 32 and box 20. For certain fluid cargos such as grain, chemical powders, granules the flexi-tank 13 may be omitted and the cargo may be contained by the box and the protective sheet 32 acting together.

In transport, to control the liquid cargo from excess surging and sloshing straps 33 may be fastened over the flexi-tank 13 (and/or liner 32) and tightened to line 13' to form a valley 34 in the flexi-tank and thus baffle the movement of the upper part of the fluid cargo 14. The straps 33 might alternatively be attached to the top corners 35 of the container as indicated by lines 33' and thus support the flexi-tank partly away from the walls 11 and add to the relief of pressure acting on the sidewalls 11.

Figure 7:
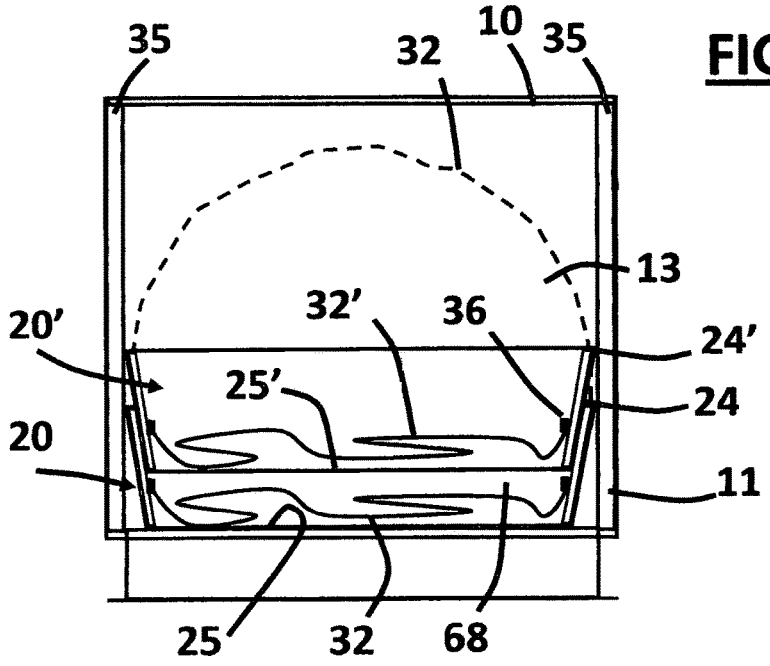
FIG. 7 shows a vertical cross section through a container with two empty boxes of the invention, nested one inside the other.

In FIG. 7, the liner 32 can be semi-permanently attached to walls 22, 23 by strip 36. When the box is empty the liner 32 can be dropped into the box 20 still attached at strip 36 for return shipment. Strip location 36 is clear of bearing points of one box upon another to avoid damage to the strip and liner, in this embodiment located within the cavity 68 between floor pans 25, 25' which is generated when one box is stacked upon another.

Empty boxes and protective sheets or liners can nest one inside another for shipping back to a home port. To get the boxes to nest one inside another the side 23 and end walls 21, 22 are outwardly sloping. For compact nesting the floor is narrower and shorter than the opening between the top rails 24. The depth of the box 20 below the top rail 24 is designed to ensure that when boxes are nested a gap or cavity 68 is maintained between the pans 25 of the nested boxes to accommodate the liners 32, empty flexi-tank, straps etc. conveniently allowing cargo ready flexi-tanks to be prepared prior to being loaded into shipping containers and filled with cargo.

Furthermore sheet 32 now covers the interior of walls 23 and pan 25 thus keeping the interior of the box 20 free from dirt contamination ready for its next use providing a dual use of sheet 32. However a further use of the sheet 32 is in that it lies in use between the sidewall 11 of the container and the flexi-tank 13 such that dirt and damage on the side wall 11 are prevented from contacting and damaging the flexi-tank when the tank is in use.

In a further utilization of the top sheet 32, non-liquid fluid cargo such as grain might be loaded into the box 20 and sheet 32 provides a housed clean environment for such products keeping them clean and dry, yet providing protection of the container from damage by the movement of the cargo. When it comes to discharge of such cargo, the provision of a door 21 seen in FIG. 3 comes into use whereby unlocking of lock 28 allows the door to be opened out and the cargo to flow out of the box 20. Typically (not shown) the container is mounted on a tipping trailer so that it can be tipped to engage gravity to assist in the discharge of the cargo.

Figure 8:
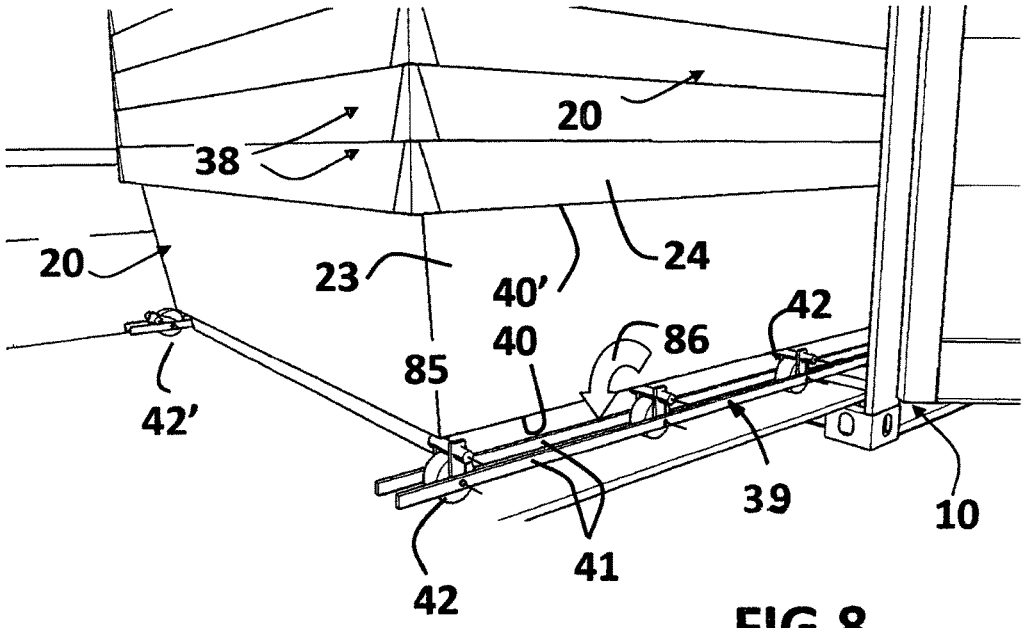
FIG. 8 shows a perspective view in close up detail of one corner of a stack of nested boxes used in arrangements in accordance with the present invention being loaded into a shipping container.

FIG. 8 shows a stack 38 of boxes 20 are nested together and are seen being loaded inside a container 10 for a return trip to collect more cargo. The stack 38 can be lifted by side frames 39 lifting the boxes 20 by lips 40 (seen also in FIG. 12C) provided on the boxes. The side frames comprise beams 41 with retractable wheels 42 mounted therein which engage to the sidewalls 23 via lips 40 to allow the complete box stack 38 to be trollied into the container. Once inside the container the side frames 39 can then be removed by retracting the wheels 42 to the position 42', as indicated by arrow 86 in FIG. 8, and lowering the beams 41 from the from the lips 40 and side walls 23. Alternatively similar lips 40' can be provided at a higher location as indicated and similar but taller versions lifting frames 39 can be devised to lift a box or stack 38.

Once inside the container the box bears on the container front vertical corner posts, and is secured to the container structure to prevent the box from moving towards the doors during transport and handling. A suitable connector is the previously described sliding bolt 29 which is housed on the top end rail 24 which can be slid out to engage with shoring slot 18 formed in the post 19 of most general cargo containers.

Optionally the height of the box 20 is engineered to suit structural requirements, cost, and weight. For the return trip the more boxes that can be shipped the lower the cost up to the point where they cannot be fitted inside a container or that the weight of the boxes equates to the carrying capacity of the container.

In FIG. 9 another arrangement is seen in which one box 20*a* can be stacked on top of another box 20*b* and then fastened one on another thus protecting a flexi-tank inside the two boxes. In this arrangement not only is the flexi-tank protected but any leak emanating from it is more securely captured.

If a single box 20*b* will suffice to contain the cargo, it is envisaged that the boxes be fitted with a hard top or roof 43 comprising a rectangular frame 43*a* with an infill panel 44. A gasket 45 is fitted around the perimeter of the roof 43 to seal the roof 43 to the top 54 of box 20*b*. A similar gasket 46 can be fitted between the boxes 20*a* and 20*b*. To help prevent liquid surging within the box 20*b*, beams 47 seen in dotted line detail can be fitted within the roof panel 44 to restrict the free movement of liquid or bulk cargo within the box. Such beams can be made strong enough to support the weight of one or more additional boxes placed on top of box 20*b*, thus enabling a stack of 3 or 4 closed boxes 20*b* with roofs 43 to be containerized. A ventilator 48 might be provided in the roof 43 to allow gases to escape from the box or to release a negative pressure that might form as a result of the contents cooling and contracting. Similarly the aperture 31 might be fitted with a sight glass to check for leaks, and/or a ventilator.

It is envisaged that the inner surfaces of the pan 25 and walls 21, 22, and 23 and door 26 can be given a thick coating of a spongy rubberized paint of coating sufficient to overcoat any weld spatter or deformation of the steel surface. Such a coating might also have insulation properties so that in extreme weathers, the cargo may be protected from the shock of temperature differences.

The shape of the box although illustrated as rectangular with sharp radiused corners where the front and rear walls meet the side walls could be formed with rounded corners to better match the rounded shape of the flexi-tank and thus support it better.

The end door 26 might be engineered to occupy the whole end wall 22 of the box 1 hinged to the pan 25 and drop down in an outward direction taking with it the end section of the top rail 24 so that personnel or even vehicles could enter the box 20. In another arrangement the whole end door 26 as described might be absent if not needed, the aperture 31 then being formed through the end wall 21.

Figure 12A:
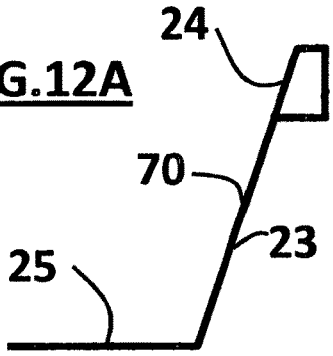
Figure 12B:
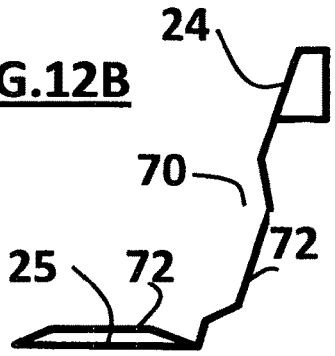
Figure 12C:
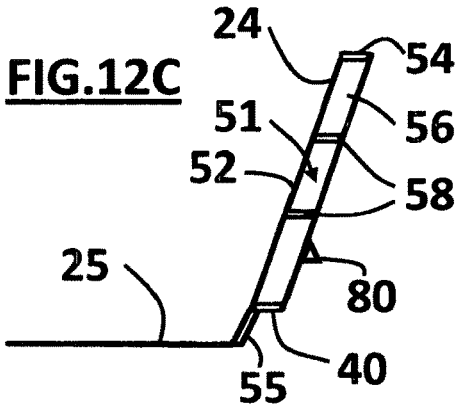
Figure 12D:
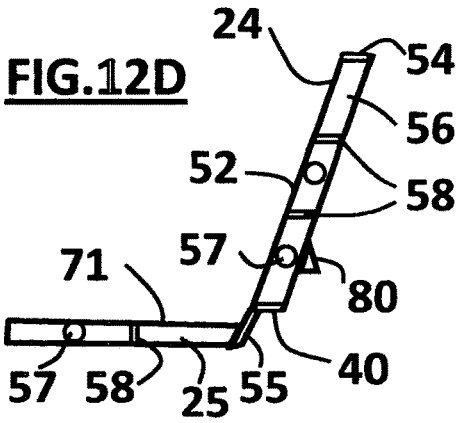
Figure 12E:
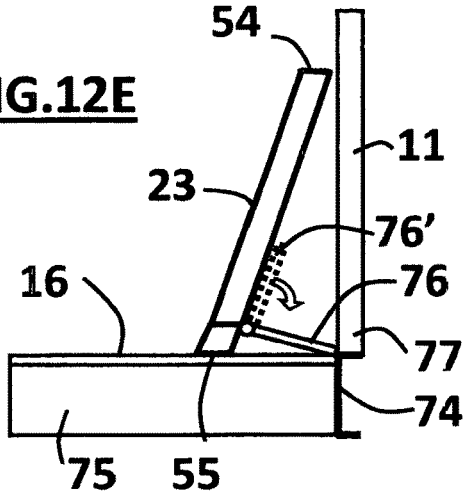

In FIGS. 12C and 10 another embodiment is shown in which all of the walls of the box 20 are formed as a double skinned box section wall 51. The components of the walls 51 are preferably steel to provide a high Young's modulus of elasticity such that when loaded they do not deflect very far. The wall section 51 has an inner skin 52 of 3 mm sheet steel, and outer skin 53 of the same material which is closed at top rail 54 and has a bottom rail 55. Gussets 58 can be welded between skins 52, 53 to stabilize the sheets under load and prevent them from buckling and thus achieve a substantial supporting structure against bending and deflection compared to the earlier example where a single sheet of steel was used in wall 23 seen in section in FIG. 12A. The ends of the box section walls 51 are closed at corners 59 where the end walls meet the side walls. This box section wall 51 thus exhibits substantial rigidity and torsional stiffness compared to the earlier singles skinned wall 23 capped by top rail 24 as seen in FIG. 12A.

The floor pan 25 supports the whole length of the wall 51 along rail 55. Rail 55 embodies the lip 40 used in lifting and transporting the box 20, as described in FIG. 8. With this double skin wall construction pipes, 57 (see FIG. 12D) can be located in the wall cavity 56 between skins 52 and 53 so that a liquid cargo 14 can be maintained or driven to desirable temperatures by pumping hot or cold fluids through the pipes either during transport or at loading or unloading of cargo. External connections to the pipes are made through openings through the skins or posts, not illustrated. Similarly the floor pan 25 might be overlaid by a second skin 71 (see FIG. 12D) and between the skins held apart by gussets 58 more pipes 57 might be laid. Pipes 57 might be substituted by electric heating wires.

The inner skin 52 of the wall can be made with drain holes, which, in the event of a leak into the box, allow the liquid to drain into the wall cavity 56 and thus improve the capacity of the box 20 to contain leaks.

As can be seen in Figure In FIG. 10, the pan 25 of the box 20 can be cambered upward to line 25" so that when empty, the pan 25 is to a degree kept upward away from stones and debris on any surface the box might rest. But once loaded with liquid 14 the camber is extinguished and the load then carried on the supporting surface such as container floor 16.

The structure of the box described is of steel but it is envisaged that carbon fibre, stainless steel or other materials might be used. The pan 25 which is supported under load by the floor 16 of the container can be flexible. Furthermore because it is used to support the wall 51 along its base as a tensile structure, it need not be made from steel. For example, it is envisaged that the pan 25 might be made from plastic, glass fibre, aluminum and indeed any other sheet materials able to provide the tensile load requirements and other objectives of this invention. Such flexible materials conform more readily to the shape of any debris it might come to rest upon and thus not become damaged.

As the double skinned box 20 has no overhanging top rail to rest on top of the adjacent box when nested, the outside of the box can be provided with nesting stops 80 which rest on the top of the adjacent box (see FIGS. 12C and 12D) and prevent the boxes jamming when nested and maintain the cavity 68 between floor pan 25, 25' of nested boxes.

Under the pressures E', F' and G' acting on the wall 51 as described above in relation to FIG. 5, but for the pan 25 restraining the bottom rail 55 of the wall 51 along its entire base, the wall 51 would deflect outward substantially. The pan 25 thus acts as a web between two opposing box walls to form a very rigid composite beam in a horizontal plane allowing minimal horizontal deflection under load. The pan 25 although of a thin material and liable to buckling, is stabilized by the uniformly distributed load of the cargo 14 in the flexi-tank bearing down on the pan against the structural floor 16. Above the level of the pan 25 the walls become less restrained and can deflect. However to control such deflection the ends of the sidewall 23 are built into the endwalls 21 and 22 which thus provide a restraining bending moment on the sidewall 23 minimizing its deflection compared to a simply supported connection to the endwalls 21 and 22. The centre of the top rail 24 of the wall 23 is the point of greatest deflection, yet the torsional stiffness of the box wall 51 built in at the ends 21 and 22 and the provision of gusset stiffeners 58 ensure that the deflection is controlled.

Fair wear and tear damage to the exterior skin 53 of walls double skinned walls of the box might take place over time from handling, but the interior skin 52 is largely protected from such impacts only coming into contact with the flexi-tank. Thus skin 52 maintains a smooth surface desirable to protect the flexi-tank from scuffing damage.

In FIG. 11 the cooperation of the box 20 and the side walls 11 of the container to absorb the forces which are encountered during transportation of the cargo 14 is illustrated. The flexibility of the box section side wall 51 illustrated of box 20 is engineered so as to work in cooperation with the flexibility of the container side walls 11. For example if the container sidewall was to reach its elastic limit at 40 mm deflection, and so too was the top side rail 54 of the box 20 to likewise reach elastic limit at 40 mm deflection plus the initial gap between the outside of the sidewall and the container, and at this deflection the cargo load were fully supported, ther this would be an engineering solution.

However in practice if the gap between the outside of the box and the adjacent side wall was not equal (e.g. zero clearance on the right hand side of the container say 30 mm clearance on the left hand side of the container) then the more flexible box 20 side structure would begin to bear more heavily on the right hand container sidewall and tend to overload it. So in the preferred embodiment, since the geometry of the container and box and the relative location cannot be accurately controlled, the side structure of the box 20 is designed to have a flexibility under its apportioned load of not more than the elastic limit of the container side wall so that as the sidewall deflects outward under its proportioned load, it does so equal or more than the wall 23 or 51 of the box 20.

FIG. 11 shows the unladen container sidewall 11 as dotted line A. An unladen box 20 with box section wall 51 is also shown as dotted detail D. There is a clearance 'X' between the wall at location D and side wall at location A. Assuming there is no box 20 in situ, when loaded with a flexi-tank under dynamic pressure, the sidewall would deflect to location B, typically 45 mm which over stresses and permanently damages that side wall. However when relieved of flexi-tank pressure by the box wall D, the sidewall deflects to location C typically 25 mm, within the elastic limit of the sidewall 11 and the wall 51 deflects under the flexi-tank pressure to location E. Ideally the wall deflection 'Z' is substantially the same as the sidewall deflection at the nearest point between the wall and sidewall, and thus the clearance 'Y' at this point is substantially equal to 'X'. In practice given manufacturing tolerances and operational positioning tolerances, clearance 'Y' can close to zero or even bear slightly on the sidewall provided that the bearing does not overload the sidewall. Wall configurations as illustrated in FIG. 12 can be substituted for wall 51 in this example provided that they conform to the rigidity and strength requirements described.

In FIG. 12 variations of the walls 21, 23 are shown. These may comprise flat or corrugated or reinforced or fluted or other known load bearing form when supported by pan 25 and top rail 24. FIG. 12A shows a pan 25 and wall sheet comprising a single thickness sheet 70 supported by top rail 24. FIG. 12B shows a similar construction to FIG. 12A with the addition of stiffeners 72 attached or pressed into the sheets 25, 70. FIG. 12C sees a box beam wall 51 as described earlier. FIG. 12D is similar to 12C but with a double sheeted floor comprising pan 25 and inner sheet 71. FIG. 12E shows a section of wall 11 of a container with container bottom rail 74 and a floor bearer 75 supporting plywood floor 16. A wall 23 of box 20 is seen and in this embodiment there is no pan 25 or if there is a pan 25 it is of a flexible nature such as being formed from a sheet of polythene. However to support the bottom rail 55 of the box 20 one or more spacers 76 are fitted at intervals along the bottom rail 55 so that should the wall 23 deflect it soon meets the rigidly held bottom 77 of sidewall 11 held by the bearers 75 and rail 74 thus restricting the deflection of the wall 23. Spacers 76 can be pivoted to position 76' when not in use In FIG. 13 there is seen the end wall 21 of the box 20 with aperture 31 passing through it. Inside the box 20 is a bladder 13 filled with fluid 14 connected (unseen) to a loading and discharge valve 94. The valve passes through the aperture 31 and as shown, should there be a leak into the box 20, the fluid could conceivably come out of the aperture 31. To prevent such leakage a cap 91 is provided this being fastened by screws 92 engaging with a flange plate 90 fixed to the end wall 21 of the box. A gasket 95 is fixed to the perimeter of the aperture 31 so as to seal the cap 91 to the box 20 thus preventing any leakage.

The cap is removed for discharging the fluid. If the empty bladder is to be shipped with the box back to base for reuse, then the valve is pushed into the space 68 denoted in FIG. 7 along with the cap 91.

It is envisaged that besides fluid, other bulk cargo such as scrap metal, rubble, soil, nuclear waste and other such materials could be carried in containers using various adaptations of the box thus minimizing damage to the container, making the transport safer, and reducing contamination of the container enabling its use for cleaner cargos on its next trip.

The various box arrangements described above, which are typically for use in 20 ft containers, can also be used in the longer typically 40 ft containers in a tandem configuration.

FIG. 14A shows such an arrangement in which two boxes 20, 20' in a tandem configuration are loaded into a container. Each box has at each top corner an aperture plate 96 details of which are shown in FIG. 14B. The aperture plate has formed through it an elongate aperture 99 similar to that of known corner fittings used in shipping containers. Two twistlocks 97 are mounted in a connecting frame 98.

These twistlocks 97, which are again similar in principle to known twistlocks used in containerization, can be inserted into the apertures 99, twisted through 90 degrees and thus used to lock or interconnect the adjacent boxes via the frames 98. Any other suitable form of connection can of course be used to connect the boxes 20, 20'. When two boxes 20,20' are placed end to end as shown in FIG. 14A they can thus be coupled together and be fixed for longitudinal movement relative to each other. Thus when placed in a long container, for example a 40 ft long container, the two boxes can be secured and then used for holding fluid cargo as previously described.

In another utilization, the tandem boxes 20, 20' might be fitted with lids as in FIG. 9B, a bladder fitted inside but filled with air and not liquid, and used as a pontoon for use on rivers or lakes of length depending on the number of boxes so coupled.

The invention claimed is:

1. A system for transporting fluid cargo comprising a walled shipping container, a membrane and a box having walls, the membrane and box independently or in combination contain the fluid cargo;

wherein the box is open topped with part of the membrane extending above an upper rim of the box and outside the perimeter of the upper rim so that a portion of the membrane extending above the upper rim and outside the perimeter of the upper rim contacts at least a portion of at least one wall of the container and wherein the box walls support the portion of the cargo within the box during transportation, the box being designed to flex and absorb only part of and not the entirety of the horizontal forces generated within the cargo during its transportation so that when a portion of the upper part of the membrane above the rim contacts the portion of the at least one wall of the container, it is prevented from applying a load to the at least one wall of the container which exceeds the elastic limit of the wall of the container.

2. The system according to claim 1, wherein the box has a floor pan which seals the box against leakage of the cargo and the cargo is contained by the flexible membrane and the box together with the membrane being sealingly attached to the box and retaining against leakage but not necessarily structurally part of the cargo above the upper rim of the box.

3. The system according to claim 1, wherein the membrane comprises a bladder which completely encloses the cargo and is disposed partially within the box to contain the cargo independently of the box.

4. The system according to claim 1, wherein a top rail extends around the upper rim of the open topped box, the top rail and box walls together supporting the portion of the cargo within the box during transportation.

5. The system according to claim 1, wherein the walls of the box are of a double skinned construction with gussets between the skins, these double skinned walls supporting the portion of the cargo within the box during transportation.

6. The system according to claim 3, wherein the box has a floor pan which seals the box against leakage.

7. The system according to claim 6, wherein the floor pan is of a double skinned construction.

8. The system according to claim 1, wherein the end wall of the box adjacent a rear door of the container includes an aperture to receive a cargo loading/unloading valve connected with the interior of the flexible membrane.

9. The system according to claim 1, wherein the box and/or the shipping container is provided with devices to position the box in a desired position on the floor of the container.

10. The system according to claim 1, wherein a protective sheet is provided which extends over the membrane to protect the membrane and to confine any leakage of the cargo through the membrane to within the box.

11. The system according to claim 1, wherein straps are provided over the top of the membrane and any protective sheet fitted to control movement of the fluid cargo within the membrane during transportation.

12. The system according to claim 1, wherein the walls of the box are outwardly sloping so that the boxes can be stored in a nested configuration when not in use and nesting stops are provided to prevent jamming when nested and which ensure spacing between the floor pans of adjacent nested boxes to accommodate any membrane or protective sheet which is used.

13. The system according to claim 1, wherein the box has fasteners which engage the shipping container to prevent relative movement between the box and container during transportation.

14. The system according to claim 1, wherein the inside of the box is coated with a spongy layer to protect the membrane from abrasion damage by contact with the box during transportation.

15. The system according to claim 5, wherein cargo cooling or heating pipes extend between the skins of the double skinned walls.

16. The system according to claim 1, wherein a pair of boxes are positioned in a tandem configuration within a container.

17. The system according to claim 16, wherein the boxes are locked together against longitudinal movement relative to each other within the container.

18. The system according to claim 1, wherein side walls of the box are supported at their base from the bases of the adjacent container walls.

19. A system for transporting fluid cargo within a walled shipping container, the system comprising a bladder and a box having walls and a floor pan that seals the box against leakage, the bladder completely enclosing the cargo and being disposed partially within the box to contain the cargo independently of the box;

wherein the box is open topped with part of the bladder extending above an upper rim of the box so that it can contact the container walls, wherein the box walls support the portion of the cargo within the box during transportation;

the box designed to flex and absorb only part of and not the entirety of the horizontal forces generated within the cargo during its transportation so that if the upper part of the bladder above the rim contacts the adjacent surrounding container walls, it is prevented from applying a load to the surrounding container walls that exceeds the elastic limit of the container walls; and wherein the floor pan of the box has a convex domed shape that curves upwardly when the bladder is empty and that deflects to a more flat configuration as the bladder is filled.

* * * * *